US005360209A

United States Patent [19]

Mollica

[11] Patent Number: 5,360,209

[45] Date of Patent: Nov. 1, 1994

[54] BATTING TRAINING DEVICE

[76] Inventor: Robert D. Mollica, 112 Dale Ave., Robert D. Mollica, 99C Arch Street, Ramsey, N.J. 07446

[21] Appl. No.: 58,456

[22] Filed: May 6, 1993

[51] Int. Cl.[5] ..... A63B 69/36

[52] U.S. Cl. ..... 273/26 R; 273/26 B; 273/72 R

[58] Field of Search ..... 273/26 B, 67 R, 72 R, 273/186.2; 72/457

[56] References Cited

U.S. PATENT DOCUMENTS

| | | | |
|---|---|---|---|
| 1,418,401 | 6/1922 | Schmidt | 273/186.2 |
| 2,471,610 | 5/1949 | Christensen | 273/72 R |
| 3,030,837 | 4/1962 | Chartier | 72/457 |
| 3,137,504 | 6/1964 | Zordan et al. . | |
| 3,173,688 | 3/1965 | Green . | |
| 3,578,801 | 5/1971 | Piazza . | |
| 4,027,886 | 6/1977 | Katsube | 273/186.2 |
| 4,274,631 | 6/1981 | Hayazaki . | |
| 4,511,139 | 4/1985 | Armstrong . | |
| 4,555,111 | 11/1985 | Alvarez . | |
| 4,634,121 | 1/1987 | Sasaki | 273/186.2 |
| 4,819,935 | 4/1989 | Dirksing | 273/26 B |
| 5,024,436 | 6/1991 | Vento . | |
| 5,133,551 | 7/1992 | Handy et al. . | |

OTHER PUBLICATIONS

"Philadelphia Sunday Bulletin", May 17 1953, 273/72 R.

*Primary Examiner*—Theatrice Brown
*Attorney, Agent, or Firm*—Samuelson & Jacob

[57] ABSTRACT

A batting training device includes a handle and a weighted member movable relative to the handle along a longitudinally extending rod in response to acceleration of the batting training device along a portion of a contact hitting swing so as to provide a visual indication to the batter, and to the batter's trainer, as to when the acceleration is made to occur along the portion of the swing appropriate to contact hitting.

8 Claims, 1 Drawing Sheet

BATTING TRAINING DEVICE

The present invention relates generally to training devices and pertains, more specifically, to a batting training device for training a baseball or softball batter in contact hitting.

Unlike power hitting, in which a bat is swung at a ball with immediate acceleration for high speed so as to gain maximum momentum and great impact upon contact With a pitched ball, contact hitting requires a more controlled swing in which the bat is drawn more slowly toward contact with the ball, with minimal acceleration, and the wrists of the batter are turned just prior to making contact with the ball so as quickly to accelerate, or "snap", the bat for accurate placement of the hit ball. While many training devices have been proposed for increasing proficiency in power hitting, these devices are not suited to learning the controlled swing necessary in contact hitting, and especially in connection with hitting in soft ball play.

The present invention provides a batting training device for training a baseball or softball batter to perform an appropriate contact hitting swing and, as such, attains several objects and advantages, some of which are summarized as follows: Provides a visible indication of the correctness of the batter's swing, observable by both the batter and the batter's trainer, enabling immediate adjustments for expedient training; assists in the accomplishment of an appropriate contact hitting swing for effective training in both hard ball and soft ball play with minimal practice; emulates the appearance and feel of an actual baseball or softball bat for ease of transition from swinging the training device to swinging an actual baseball or softball bat; provides a relatively simple construction which is easy to use and will not intimidate even young trainees and novices; enables economical manufacture for inexpensive construction and widespread use; provides a relatively rugged device capable of reliable performance over an extended service life.

The above objects and advantages, as well as further objects and advantages, are attained by the present invention which may be described briefly as a batting training device for training a batter to perform an accurate contact hitting swing, in which swing the wrists of the batter are turned relative to the arms of the batter for proper acceleration of the batting training device only during that portion of the swing subsequent to the batting training device crossing the center plane of the body of the batter, the batting training device comprising: a handle extending longitudinally along a longitudinal axis, the handle having a configuration generally emulating the handle portion of a conventional bat; a weighted member; and coupling means coupling the weighted member with the handle for visible movement along the longitudinal axis between a near position juxtaposed with the handle and a far position spaced longitudinally away from the near position in the direction extending longitudinally away from the handle such that upon swinging the batting training device through the contact hitting swing, the position of the weighted member relative to the handle is observed visually, enabling adjustment of the swing by the batter to assure that the weighted member moves from the near position toward the far position in response to acceleration of the batting training device only during that portion of the swing appropriate to contact hitting.

The invention will be understood more fully, while still further objects and advantages will become apparent, in the following detailed description of a preferred embodiment of the invention illustrated in the accompanying drawing, in which.

Figure 1:
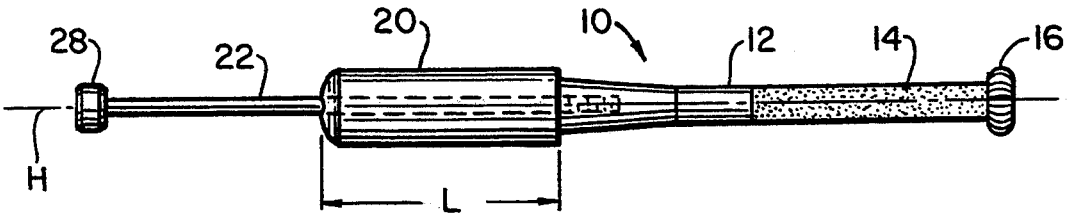
FIG. 1 is a plan view of a batting training device constructed in accordance with the present invention.
Figure 2:
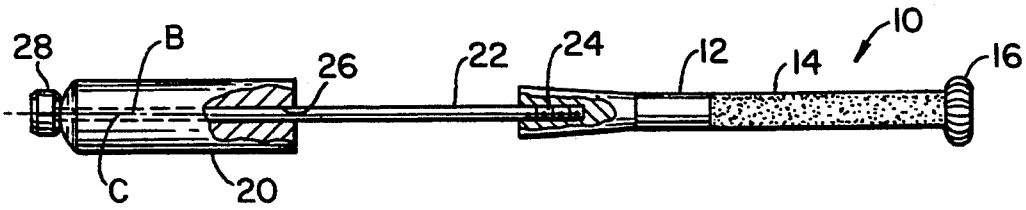
FIG. 2 is a plan view similar to FIG. 1, but with a component part in another operating position.

Referring now to the drawing, and especially to FIGS. 1 and 2 thereof, a batting training device 10 is constructed in accordance with the invention and is seen to include a handle 12 which generally emulates the handle portion of a conventional baseball or softball bat. Handle 12 extends longitudinally along a longitudinal axis H and includes a hand grip 14 to be gripped by a batter in the conventional manner, and a knob 16 at one end of the handle 12.

A weighted member 20 is coupled for movement relative to the handle 12 by coupling means which include a rod 22 secured to the handle 12 so as to be integral with the handle 12, as by a threaded connection at 24. Weighted member 20 preferably has a generally cylindrical configuration, so that training device 10 is made to resemble, somewhat, a traditional baseball or softball bat, and includes a central longitudinal bore 26. Rod 22 passes through bore 26 and is complementary with bore 26 so that weighted member 20 slides freely along rod 22 between a near position adjacent the handle 12, as illustrated in FIG. 1, and a far position spaced longitudinally away from the near position, as seen in FIG. 2.

A stop 28 is integral with the rod 22 adjacent the far position and serves to positively stop weighted member 20 from traveling beyond the far position. The cylindrical configuration of weighted member 20 includes a central axis C, and the bore 26 includes a central axis B. Preferably, the axes H, C and B are aligned coaxially for balanced performance. The longitudinal length L of the weighted member 20 is substantially less than the longitudinal distance between the near and far positions so that the position of the weighted member 20 along the rod 22 is visually apparent at any position of the weighted member 20 along the rod 22. In the illustrated embodiment, the length L of the weighted member 20 is about one-half the distance between the handle 12 and the stop 28. The weight of the weighted member 20 is chosen to attain an optimum indication, and may be varied from device to device in much the same manner as baseball or softball bats of different weights are selected by individual batters.

Figure 3:
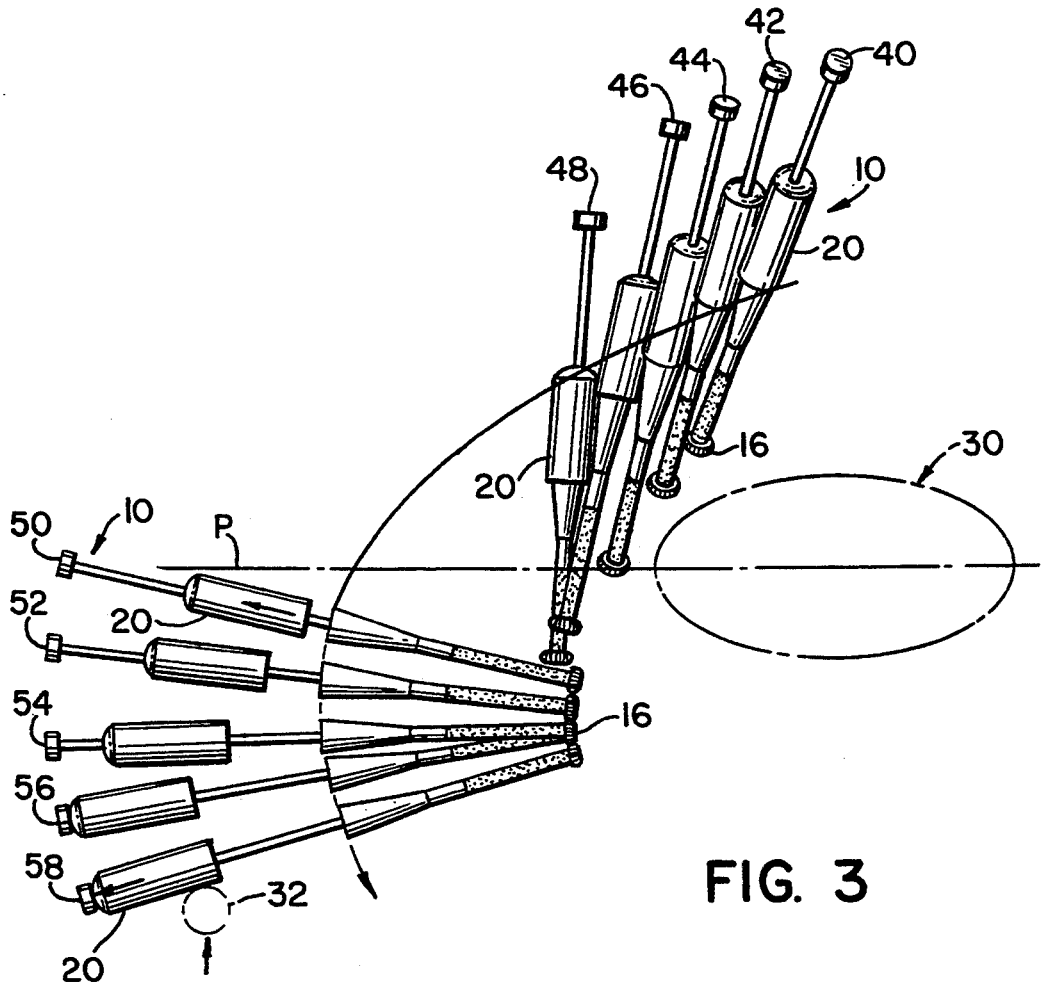
FIG. 3 is a diagrammatic plan view demonstrating the use of the batting training device.

Turning now to FIG. 3, batting training device 10 is illustrated diagrammatically in a plurality of positions throughout a contact hitting swing. A batter is seen from above and is depicted in phantom at 30, in a stance appropriate for striking a ball generally at the location shown at 32. At the beginning of the swing, the batting practice device 10 is held in an upwardly directed angled orientation, as seen at position 40. The batting practice device 10 then is pulled forward and downwardly though the positions depicted at 42, 44, 46 and 48. During the portion of the swing illustrated by positions 42, 44, 46 and 48 the batting practice device 10 is moved slowly, with little or no acceleration so that weighted member 20 remains in the near position. The knob 16 of the handle 12 follows an almost straight line extending through a central plane P of the batter. This portion of the swing is accomplished with no turning of the wrists of the batter 30 relative to the arms of the batter 30, so that there will be no snapping or whipping of the batting training device 10. The purpose of this portion of the swing in contact hitting is merely to position a bat in the appropriate location for hitting the ball. In contrast, during power hitting, this same portion of the swing is executed at maximum acceleration so as to build up momentum for maximum striking force upon a hit ball.

Upon reaching the central plane P of the batter 30, the batting training device 10 is accelerated relatively quickly, by then turning the wrists of the batter 30 relative to the arms of the batter 30; that is, the wrists are turned to "snap" or whip the batting practice device 10 through a rapid acceleration over the positions depicted at 50, 52, 54, 56 and 58. This turning takes place essentially about the position of knob 16, with little or no displacement of the arms of the batter 30 and little or no translation of the knob 16 as the batting practice device 10 swings through positions 52, 54 and 56. Upon reaching position 58, optimum position and impact have been attained for hitting a ball which ordinarily will be at 32. The appropriate desired rapid acceleration is indicated by movement of the weighted member 20 along the rod 22 from the near position to the far position. Movement of the weighted member 20 is visible and is observed readily by the batter 30. In addition, a batting trainer may observe the movement of the weighted member 20 throughout the swing and advise the batter accordingly. Should the batter 30 accelerate the batting training device by turning the wrists outwardly, away from the batter 30, too early in the swing, that acceleration will be detected immediately by observing movement of the weighted member 20 away from the near position and immediate corrections can be made in the swing. The batter 30 soon learns how to swing with a whipping action at that portion of the swing appropriate for maximum effect in contact hitting. In this manner, the batter 30 becomes proficient in hitting a ball with increased effectiveness and accuracy in placement.

It will be seen that the present invention attains the several objects and advantages summarized above, namely: Provides a visible indication of the correctness of the batter's swing, observable by both the batter and the batter's trainer, enabling immediate adjustments for expedient training; assists in the accomplishment of an appropriate contact hitting swing for effective training with minimal practice; emulates the appearance and feel of an actual baseball or softball bat for ease of transition from swinging the training device to swinging an actual baseball or softball bat; provides a relatively simple construction which is easy to use and will not intimidate even young trainees and novices; enables economical manufacture for inexpensive construction and widespread use; provides a relatively rugged device capable of reliable performance over an extended service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A batting training device for training a batter to perform an accurate contact hitting swing, in which the wrists of the batter are turned relative to the arms of the batter for proper acceleration of the batting training device only during that portion of the swing subsequent to the batting training device crossing the center plane of the body of the batter, the batting training device comprising:

a handle extending longitudinally along a longitudinal axis, the handle having a configuration generally emulating the handle portion of a conventional bat and including a handgrip of sufficient length along the longitudinal axis to be gripped by the batter in a conventional two-hand batting manner;

a weighted member of predetermined weight and dimensions; and coupling means coupling the weighted member with the handle for visible movement essentially freely along the longitudinal axis at all positions between a near position juxtaposed with the handle and a far position spaced longitudinally away from said near position in the direction extending longitudinally away from the handle, the weight and dimensions of the weighted member being sufficient to emulate the appearance and feel of the conventional bat while enabling said visible movement throughout the entire swing such that upon swinging the batting training device through the contact hitting swing, the position of the weighted member relative to the handle is observed visually, enabling adjustment of the swing by the batter to assure that the weighted member moves from said near position toward said far position in response to acceleration of the batting training device only during that portion of the swing appropriate to contact hitting.

2. The invention of claim 1 wherein the weighted member has a generally cylindrical external configuration including a central axis, the central axis being coaxial with the longitudinal axis.

3. The invention of claim 1 wherein the coupling means includes a rod integral with the handle, and the weighted member is coupled for essentially freely sliding movement along the rod between the near position and the far position.

4. The invention of claim 3 wherein the rod includes a stop adjacent the far position for engagement with the weighted member to positively stop the weighted member upon arrival of the weighted member at the far position.

5. The invention of claim 3 wherein the weighted member includes a central longitudinal bore complementary to the rod such that the rod extends through the bore for/essentially free movement of the weighted member as the weighted member slides along the rod between the near position and the far position.

6. The invention of claim 5 wherein the rod includes a stop adjacent the far position for engagement with the weighted member to positively stop the weighted member upon arrival of the weighted member at the far position.

7. The invention of claim 6 wherein the weighted member has a given longitudinal length and the longitudinal distance between the handle and the stop is substantially greater than the longitudinal length of the weighted member such that movement of the weighted member from the near position toward the far position is readily observable.

8. The invention of claim 7 wherein the weighted member has a generally cylindrical external configuration including a central axis, the central axis and the central bore being coaxial with the longitudinal axis.

* * * * *